US005875825A

United States Patent [19]

Roberts, Jr.

[11] Patent Number: 5,875,825

[45] Date of Patent: Mar. 2, 1999

[54] MULTI-FUEL BIB

[76] Inventor: John Harold Roberts, Jr., 138 Johnstone La., Georgetown, S.C. 29440

[21] Appl. No.: 984,131

[22] Filed: Dec. 3, 1997

[51] Int. Cl.[6] ..... B65B 1/04

[52] U.S. Cl. ..... 141/86; 141/311 A; 141/343

[58] Field of Search ..... 141/86, 87, 311 A; 220/573; 114/211, 343

[56] References Cited

U.S. PATENT DOCUMENTS 4,278,115 7/1981 Briles et al. .

4,696,330 9/1987 Raudman et al. .

5,222,534 6/1993 Wilkinson, Jr. .

5,715,876 2/1998 Burt ..... 141/86

5,762,114 6/1998 Petersen ..... 141/86

*Primary Examiner*—Steven O. Douglas

[57] ABSTRACT

A portable device for the retention of multi-fuel tanks on board marine vessels during the refueling process. The receiving receptacle will fit around the air vent on said tanks. Thus catching discharged fuels in its basin; from there it will pass into its own holding tank for later removal. It will cling to the side of vessel's hull with the aid of rope, counter weights and leverage levers.

1 Claim, 2 Drawing Sheets

MULTI-FUEL BIB

CROSS-REFERENCE TO RELATED APPLICATIONS

Not Applicable

STATEMENT REGARDING FEDERALLY SPONSORED RESEARCH OR DEVELOPEMENT

Not Applicable

REFERENCE TO MICROFICHE APPENDIX

Not Applicable

BACKGROUND OF THE INVENTION

For retention of air vented fuel or gas, which is expelled during the refueling process of fixed fuel or gas tanks in a pleasure or commercial vessel. Most all fuel tanks are vented over the side of the vessel; hence when the tank is near full, it starts to expel fuel or gas over the side of the boat into the water. It is a hazard to the environment, also a danger to human life and property. The U.S. Coast Guard has seen fit to impose large fines to deter this from happening. But there are still large amounts of fuel being spilled into our waterways, lakes and oceans from the same process of filling tanks every day. Much of this same fuel or gas can be seen on our waters as its film spreads and its rainbow effects can be seen and smelled from some distance away. People who go to sea want to be assured their fuel tanks are full, so when the fuel comes to the top of their tanks, and spills fuel out of the fuel air vent, they will repeat the process, spilling more fuel into the water. Seldom will this fuel be retrieved with sorbent pads without an official nearby. Nor will the person turn himself in or the fuel attendant turn his customer into the proper officials. At this point the government may have it cleaned at the tax payer's expense. Prior art to address this problem has been submitted by Wallace E. Briles in U.S. Pat No. 4,696,330, his application was for fixed stationary fuel tanks which comprise of a manhold, downspout and airvent. While the same parts are used in the Marine Fuel Bib, his application would not be feasible for fixed fuel tanks on marine vessels. Charles E. Wilkinson, Jr. also devised a catch basin for spilt waste in U.S. Pat. No. 5,22,534, the application for which it was designed has the same object in mind but also is not feasible of the task of collecting waste fuels from marine vessels.

These applications are designed for very specific methods for collection of waste; however, neither of these applications addresses the waste from the marine fueling process. Our waterways are in dire need of a fuel collection system that will catch these fuels before polluting the waters.

BRIEF SUMMARY OF THE INVENTION

The Multi-fuel Marine Bib is a device which will be temporarily mounted over the fuel tanks air venting system, which expels fuel during the refueling of Marine vessels.

The advantage and object of the bib is to capture and to contain fuels that discharge while refueling. The catch basin will surround the fuel tank's air vents exhaust and capture fuel as it is expelled. From the basin, the fuel will be diverted into its own holding tank by way of a drain pipe, which connects from the bottom of the catch basin to the top of the holding tank.

Said holding tank shall have its own air vent which will allow an outlet for the escaping air. Said air vent shall be attached from the top of the holding tank to the top of the catch basin and vent into the inside of the basin. This will insure an even flow. Should there be a fuel discharge from its holding tank, it will be contained within its own catch basin.

The fuel bib will be manipulated on the vertical plane via four lines of rope, two leverage levers and friction pads. All components of the bib will attach to a back board. Two lines will attach to the top of the back board to adjust the height and assist in affixing the bib to the plane. Two more lines will attach to the two leverage levers, which are mounted near the bottom. The top of the leverage levers will apply pressure near the top of the back board on two hard points. This will apply pressure to the top of the bib so as to hold it against the vertical plane and the mouth of the bib catch basin around said fuel exhaust vent. Thus a deterrent to fuel spillage.

BRIEF DESCRIPTION OF DRAWINGS

FIG. 2 1 is a back view of the multi-fuel Marine bib device.

DETAILED DESCRIPTION OF THE INVENTION

Figure 1:
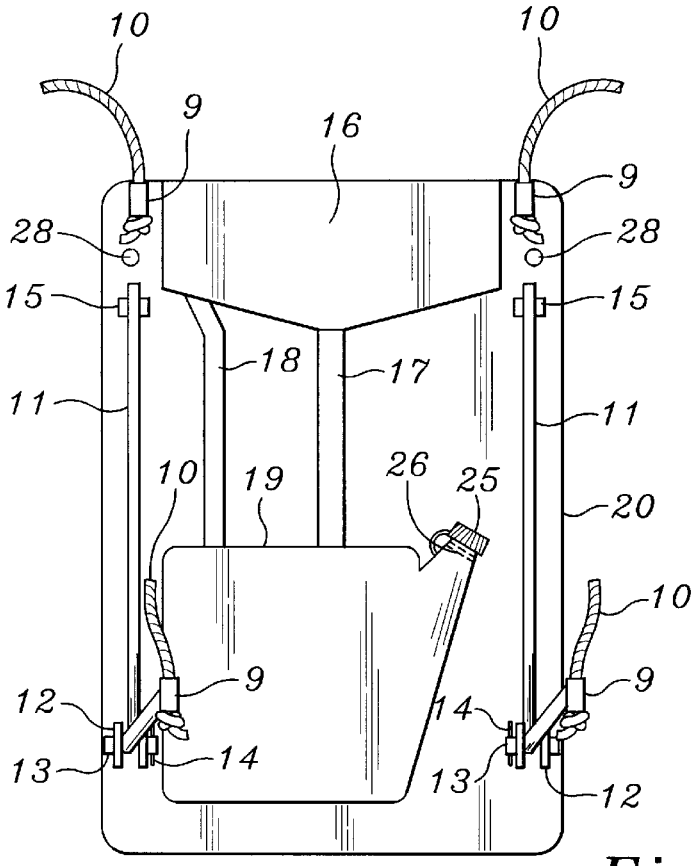
FIG. 1 is a front view of the multi-fuel Marine bib device.

In FIG. 1, a marine fuel catch basin for catching fuel expelled out of the side of vessels through fuel tank air vents. Said catch basin shall be mounted to the vertical side of vessels during the refueling process by four lengths of rope 10. The top two ropes will be tied off at an acceptable height so that the mount 22 will fit around the fuel vent. The bottom two ropes are to be pulled up, which raises the bottom of the back board 20, at the same time, pull the leverage lever 11 which applies pressure to the two hard points 15 near the top. This will induce a forward and downward pressure to the top angled section of the back board 20. The mouth 22 is flush around the fuel vent at this time. The friction paid 21 and weight 23, will assist in stabilizing basin FIG. 1. Once this is complete, tie the bottom two ropes off.

Figure 2:
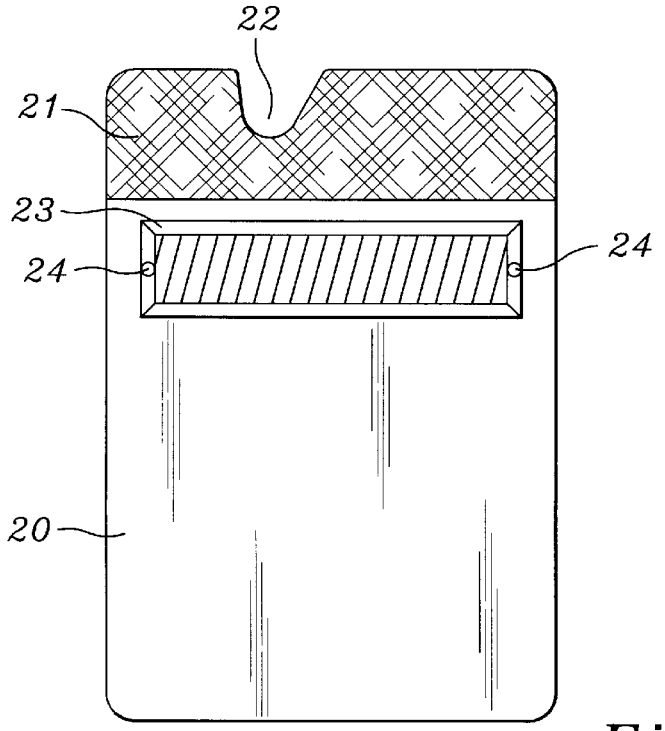
Figure 3:
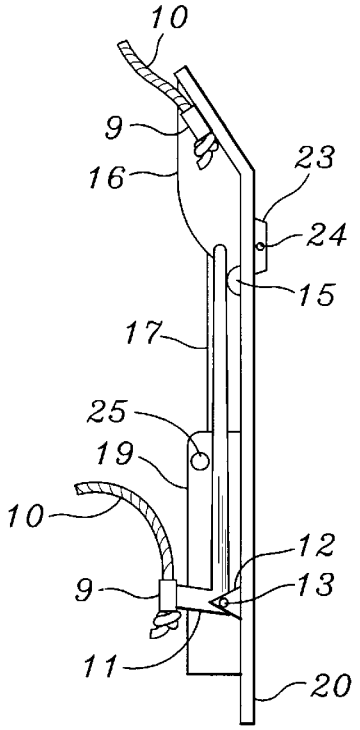
FIG. 3 is a left-side view of the multi-fuel Marine bib device.
Figure 4:
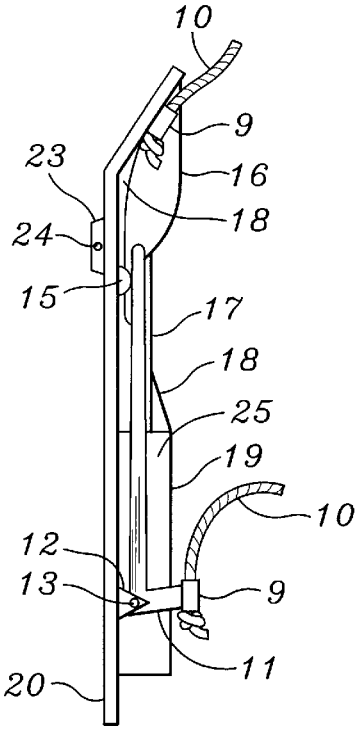
FIG. 4 is a right-side view of the multi-fuel Marine bib device.
Figure 5:
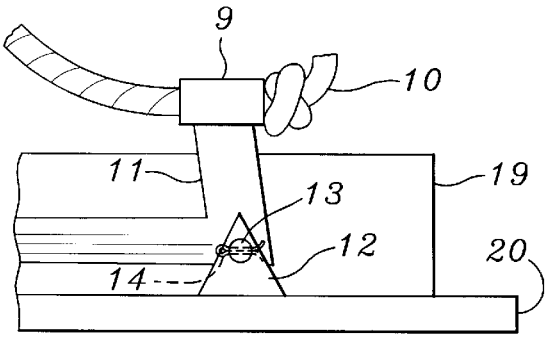
FIG. 5 is a sectional, larger scale side view of the leverage lever mount on the multi-fuel Marine bib device.

The best mode for carrying out this invention would be a two part mold injection. One mold injection would produce the front half which would include the following segments: The top two eyelets 9, hard points 15, catch basin 16, down-spout 17, air vent 18, holding tank 19, mounting brackets 12, holes 28 and the back board FIG. 2. The second mold injection would include the back half of the back board 20, holes 28 (not shown) and the mouth. Then the two halves will be joined by Vulcanizing them together. The weight 23 will be attached by two brads 24 into the two holes 28 of FIG. 1. The friction pad will be affixed via adhesive FIG. 2. The leverage lever 11 and eyelet 9 shall also be mold injected as 1 part. The leverage lever 11 will be connected to the mounting bracket 12 by a pinshaft 13 slid through one side of mounting bracket 12, through leverage lever 11 and out the reverse side of mounting bracket 12. Pinshaft 13 will then have a carter pin 14, it will be slid through the hole in the pinshaft, at this time, the two legs of the carter pin 14 will be bent in opposite directions FIG. 5. The rope 10 will be slid through the eyelet 9 and be tied off FIG. 5. All four ropes will be tied off after being placed through eyelets 9.

Figure 6:
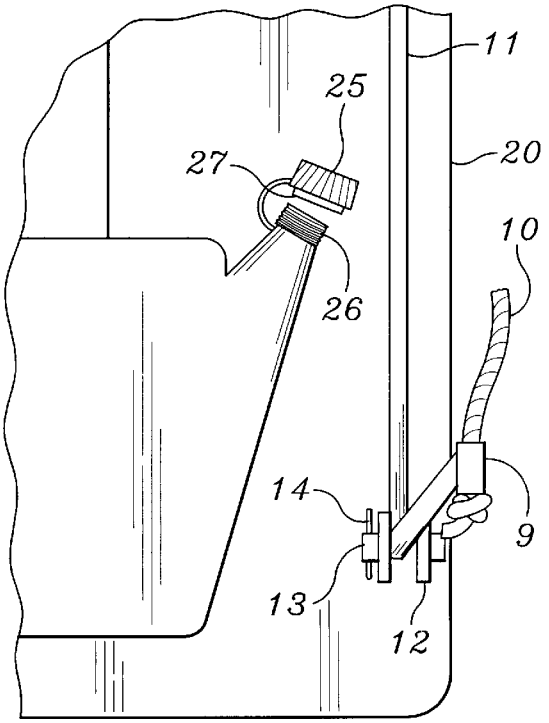
FIG. 6 is a sectional larger scale

The catch basin will have its own holding tank 19 FIG. 6. Said holding tank 19 will have an outlet 26, this will be for the removal of fuel waste. Said outlet 26 will also have a cap 25 and a gasket 27. Said cap 25 and outlet 26 will be treated so that they will be securely attached.

When the catch basin is mounted, the fuels that are expelled through the fuel tank's air vent will be caught in said catch basin 16, from there it will drain through the down spout 17 into a holding tank 19. If the holding tank 19 should discharge fuel its air vent 18 will expel waste fuel into its own catch basin 16. When the refueling process is done, the catch basin will be removed from vessel and drained of fuel waste, then set aside to await the next refueling process.

I claim:

1. A multi-fuel spill control device that is portable and arranged to be mounted over air vents of fixed fuel tanks to catch expelled fuel waste during the refueling of marine vessels, comprising:

a rectangular backboard;

a circular shaped half basin disposed at the top of the backboard;

a down spout projecting from the bottom of the basin to interconnect with the top of a holding tank;

said holding tank being positioned on the lower half of said backboard;

a pair of mounting brackets disposed on said backboard with one L-shaped leverage lever for each bracket to extend to hard points disposed near the top of the backboard; and four lengths of rope, two of which are attached to said leverage lever to aid in hoisting the device from the side of a marine vessel and the other two are attached to the top corners of said backboard to secure the device to the marine vessel.

* * * * *